US006996957B2

(12) United States Patent
Francesco

(10) Patent No.: US 6,996,957 B2
(45) Date of Patent: Feb. 14, 2006

(54) INDUCTION DEVICE FOR SHRINKING HEAT-SHRINKING FILMS ONTO PRODUCTS TO BE PACKAGED, PACKAGING SYSTEM COMPRISING SUCH DEVICE, AND HEAT-SHRINKING FILM USED THEREWITH

(75) Inventor: Torre Francesco, Dalmine (IT)

(73) Assignee: Minipack-Torre S.p.A., Dalmine (IT)

( * ) Notice: Subject to any disclaimer, the term of this patent is extended or adjusted under 35 U.S.C. 154(b) by 286 days.

(21) Appl. No.: 10/399,487

(22) PCT Filed: Oct. 3, 2001

(86) PCT No.: PCT/IT01/00506

§ 371 (c)(1),
(2), (4) Date: Apr. 16, 2003

(87) PCT Pub. No.: WO02/35887

PCT Pub. Date: May 2, 2002

(65) Prior Publication Data

US 2004/0040265 A1 Mar. 4, 2004

(30) Foreign Application Priority Data

Oct. 17, 2000 (IT) ..... TO2000A0968

(51) Int. Cl.
*B65B 53/02* (2006.01)

(52) U.S. Cl. ..... 53/557; 156/379.6; 156/380.9; 156/499; 219/388

(58) Field of Classification Search ..... 156/379.6, 156/379.7, 380.9, 84, 499; 219/653, 672, 219/200, 385, 388; 53/442, 48.2, 556, 557; 34/247

See application file for complete search history.

(56) References Cited

U.S. PATENT DOCUMENTS

| | | | | |
|---|---|---|---|---|
| 3,738,892 A | | 6/1973 | Curcio | 156/380 |
| 3,941,643 A | | 3/1976 | Balla | 156/380 |
| 5,013,878 A | * | 5/1991 | Fries, Jr. | 219/633 |
| 5,794,096 A | * | 8/1998 | Okabayashi | 399/33 |
| 5,874,713 A | * | 2/1999 | Cydzik et al. | 219/633 |
| 6,121,592 A | * | 9/2000 | Fishman et al. | 219/661 |

FOREIGN PATENT DOCUMENTS

| | | |
|---|---|---|
| EP | 1 013 551 A2 | 6/2000 |
| GB | 1015716 A | 7/1966 |

* cited by examiner

*Primary Examiner*—John T. Haran
(74) *Attorney, Agent, or Firm*—David A. Farah; Sheldon & Mak PC

(57) ABSTRACT

An induction device for heat-shrinking a heat-shrinking film onto a product comprising induction means for causing the heat-shrinking plastic layer of the heat-shrinking film to heat-shrink onto the product, and supply and control means for the induction means connected to the induction means, where the induction means comprises at least one induction ring within which the product passes while the heat-shrinking film heat-shrinks onto the product.

8 Claims, 4 Drawing Sheets

INDUCTION DEVICE FOR SHRINKING HEAT-SHRINKING FILMS ONTO PRODUCTS TO BE PACKAGED, PACKAGING SYSTEM COMPRISING SUCH DEVICE, AND HEAT-SHRINKING FILM USED THEREWITH

CROSS-REFERENCE TO RELATED APPLICATIONS

This application claims priority from International Patent Application PCT/IT01/00506 entitled "Induction Device For Shrinking Heat-Shrinking Films Onto Products To Be Packaged, Packaging System Comprising Such Device, And Heat-Shrinking Film Used Therewith," filed Oct. 3, 2001, which claims priority from Italian Patent Application TO2000A000968 entitled "Induction Device For Shrinking Heat-Shrinking Films Onto Products To Be Packaged, Packaging System Comprising Such Device, And Heat-Shrinking Film Used Therewith," filed Oct. 17, 2000; the contents of which are incorporated by reference herein in its entirety.

FIELD OF THE INVENTION

The present invention refers to an induction device, particularly an electromagnetic induction device, for shrinking heat-shrinking films on products to be packaged, to a packaging system comprising such device, and to the heat-shrinking film that can be used for such purpose.

BACKGROUND

Technologies and systems are known in the art that are applied to machines adapted for packaging different products with plastic-type heat-shrinking films. These machines, both of the manual and of the automatic types, use plastic heat-shrinking films with different thicknesses. A source of heat produced by electric resistances heats an air circuit taking the machine to the suitable temperature for shrinking the heat-shrinking film. This hot air flows onto the heat-shrinking film into which the product to be packaged is wrapped and makes the film shrink, performing the adherent packaging of the product inside the plastic film.

Machines are further known that use, for shrinking the films, sources of heat realised through infrared-rays-emitting diffusers.

Other systems, according to the type of product to be packaged, use, as heat source, hot water, or high-temperature steam.

The above machines, adapted for packaging various products with heat-shrinking films, have, in the majority of cases, an arrangement comprising a basement that supports coils of heat-shrinking film (single-bend type or not) and that contains a film-welding frame, and a conveyor or roller belt for passing the product inside an hot-air circulating oven. Obviously, the products, before passing into the shrinkage area (with hot air or the like), are wrapped, in the packaging area, by the heat-shrinking film, and this latter one is welded in its open edges by means of the welding frame with hot welding blades. Afterwards, the product, wrapped into the heat-shrinking film, passes through the oven, where heat is emitted, and then shrinks around the product itself. These machines can be of the manual, semi-automatic and completely automatic types.

Another type of known packaging is the so-called "bundle" type. The product is wrapped by a heat-shrinking film in a single sheet and shaped as a bundle; then, the film is welded and cut, and afterwards the film-wrapped product passes into the heating oven, where the film, stably adhering to the product, is shrinked.

The process that allows sending hot air onto the heat-shrinking film and other systems (for example infrared rays) can create some difficulties in the positive outcome of a constant film heat-shrinkage. In fact, into hot-air circulating ovens, hot air cannot be constantly and smoothly sent onto the whole film, and therefore its shrinkage does not perfectly occur, and in some cases there remain unshrinked film edges on the product, impairing the packaging appearance.

Moreover, the ovens must be perfectly insulated, and, in spite of modern insulation technologies, hot air goes out of the product insertion areas and out of the product output areas. This inconvenience can create pollution from heat in the environment where these machines operate.

The above problems occur for infrared heating systems, that, in addition to the above-described inconveniences, have the problem of propagating also on the product to be packaged, since the plastic film, being of a transparent type, lets these infrared rays pass with consequent energy waste. GB-A-1 015 716 discloses a method of packaging a column of disc-shaped articles that uses, among others, a pulsating magnetic field to heat objects so that a shrinkable film can be shrinked over the heated objects.

EP-A-1 013 551 a method and apparatus to package objects with a heat-shrinkable sheet which is an example of the above-mentioned prior art.

SUMMARY

Object of the present invention is solving the above prior-art problems by providing an improved system for packaging products through heat-shrinking films equipped with an induction device (of the electromagnetic type or the like) that is able to heat-shrink the film without using an oven or the above-mentioned heating means. For such purpose, a plastic film is produced where a component (of the metallic type or another one suitable for such purpose) is inserted, as an integral part of the film itself, such component reacting by heating itself when it is invested by a wave-emitting source (electromagnetic or another type of waves).

With the above-mentioned system and device, machines can be realised that are much simpler than the currently-used ones, since the oven component or another type of heat source is A removed, greatly reducing the costs, making the heat-shrinkage efficient on the whole product in a complete and uniform way, and avoiding heat pollution problems and the other insulation problems related to ovens.

A further object of the present invention is providing a heat-shrinking film adapted to be used with the device and the system of the present invention, in order to obtain the objects for which they are provided.

The above and other objects and advantages of the invention, as will appear from the following description, are obtained by a device, a system and a heat-shrinking film according to the present invention.

FIGURES

The present invention will be better described by some preferred embodiments thereof, given as a non-limiting example, with reference to the enclosed drawings, in which.

DESCRIPTION

As mentioned above, the device of the invention, for its operation, provides for the use of a plastic film into which, as integral part of the film itself, a component is inserted (of the metallic type or another one suitable for the purpose), that reacts by heating itself when it is invested by a source emitting waves (electromagnetic or another type of waves). These waves can be of a frequency made suitable to produce an induction heating (electromagnetic induction or induction of a different nature) in order to heat the parts (metallic parts or parts from different compounds) that are the integral part of the heat-shrinking film. Obviously, these metal parts or other, uniformly laid on the film, by heating themselves make the film heat-shrink on the product in a constant and uniform way.

Figure 7:
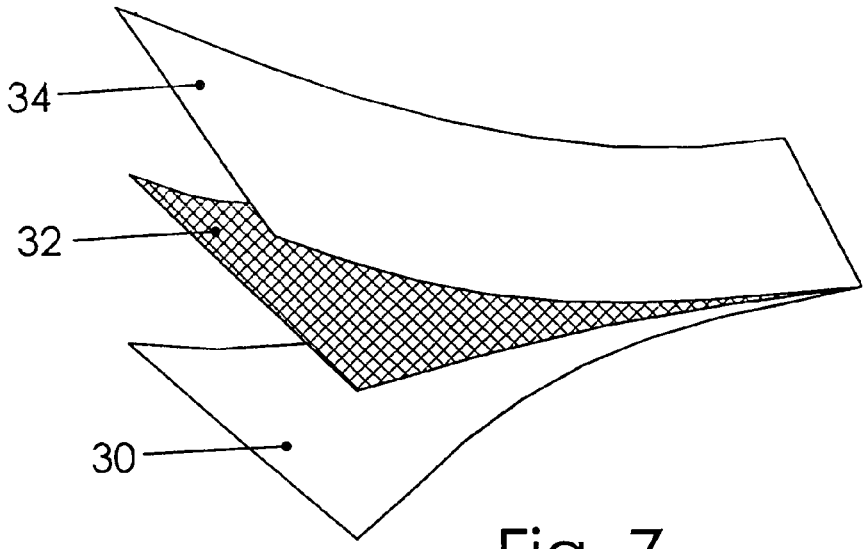
FIG. 7 is a perspective view of a preferred embodiment of the heat-shrinking film to which the device and the system of the present invention can be applied.

Co-extruded heat-shrinking films are commercially available, that are formed by two or more layers of film having different chemical and molecular characteristics, and suitable for specific purposes. In this case, as shown in FIG. 7, the film 32, containing metallic parts or other, can be inserted between two layers of uncharged heat-shrinking film 30, 34, guaranteeing their normal shrinking functionality.

Figure 1:
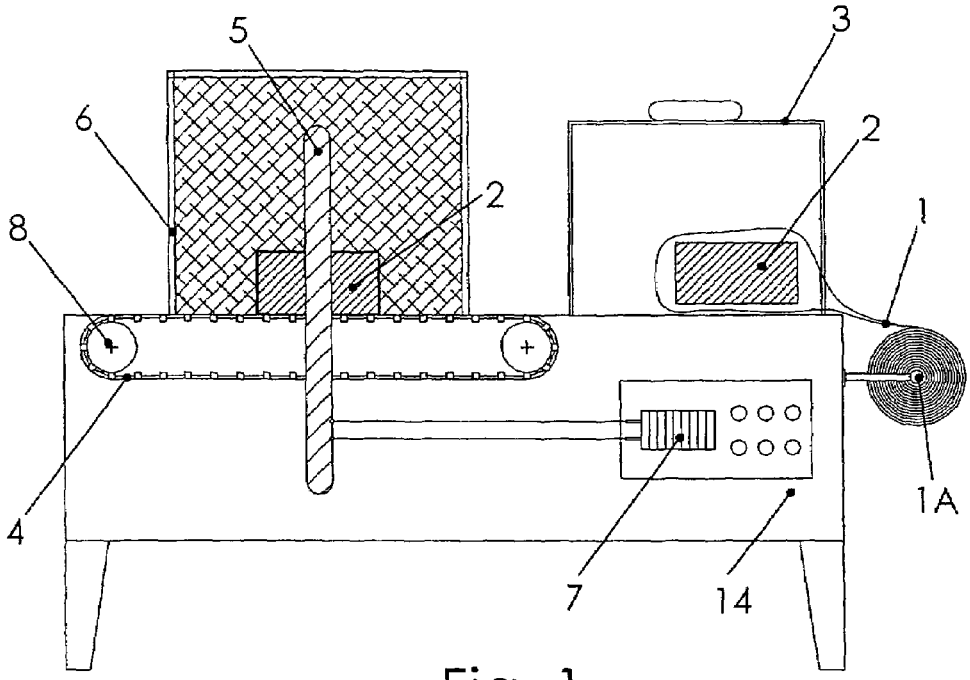
FIG. 1 is a schematic side view of a possible embodiment of the device and system according to the present invention.

With reference first of all to FIG. 1, an embodiment of the device and the system or the present invention are shown as non-limiting examples.

The packaging system of the invention substantially comprises:

- a support structure 14 on which all system components are installed;
- means 1A for supplying a heat-shrinking film 1 for packaging a product 2, where such means 1A are commonly composed of a coil or roller of film 1;
- welding means 3 for welding the heat-shrinking film 1 on the product 2, where such welding means 3 are commonly composed of a welding frame; and
- downstream of the welding means 3 along the advancement direction of the product 2 during its packaging, at least one induction device that allows shrinking the heat-shrinking film 1 onto the product 2.

The induction device generates such effect by emitting waves: the induction can therefore be, in the most common and immediate way, of the electromagnetic type, but the protective scope of the invention is also open to other types of induction by using different waves adapted to heat the heat-shrinking film.

In particular, as shown in FIG. 1, the system can be further equipped with at least one conveyor belt 4, driven by rollers 8, adapted to handle the product 2 from the packaging station into the film 1 to the induction device for shrinking the film 1 onto the product 2.

Moreover, if a further environmental protection from electromagnetic waves is necessary (even if the system of the invention, in its standard form, does not need it), the system could also be equipped with protection means 6 from the waves emitted by the induction device, placed around the device itself. In particular, the protection means 6 are composed (FIG. 1) of a tunnel shaped as a metallic protection cage, inside which the device is contained and inside which the product 2 to be packaged passes; obviously, numerous variations of such protection means 6 are possible.

With reference now in particular to the induction device characterising the above-mentioned system, it indeed allows shrinking, by applying heat, a suitable heat-shrinking film 1 on a product 2 to be packaged. Moreover, such device comprises:

- induction means 5, 10, 12, 14, 16, 18, 20, 21, 22 suitable for subjecting the product 2 equipped with the heat-shrinking film 1 to such an induction that the film 1 shrinks onto the product 2; and
- supply and control means 7 of the induction means 5, 10, 12, 14, 16, 18, 20, 21, 22.

Figure 2:
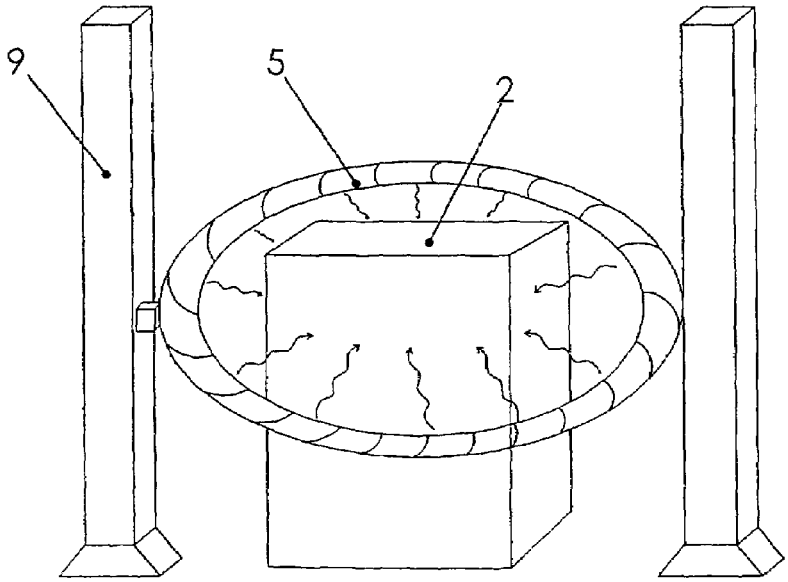
FIG. 2 is a schematic view of another possible embodiment of the device of the invention used for packaging pallets of goods having big sizes.
Figure 4:
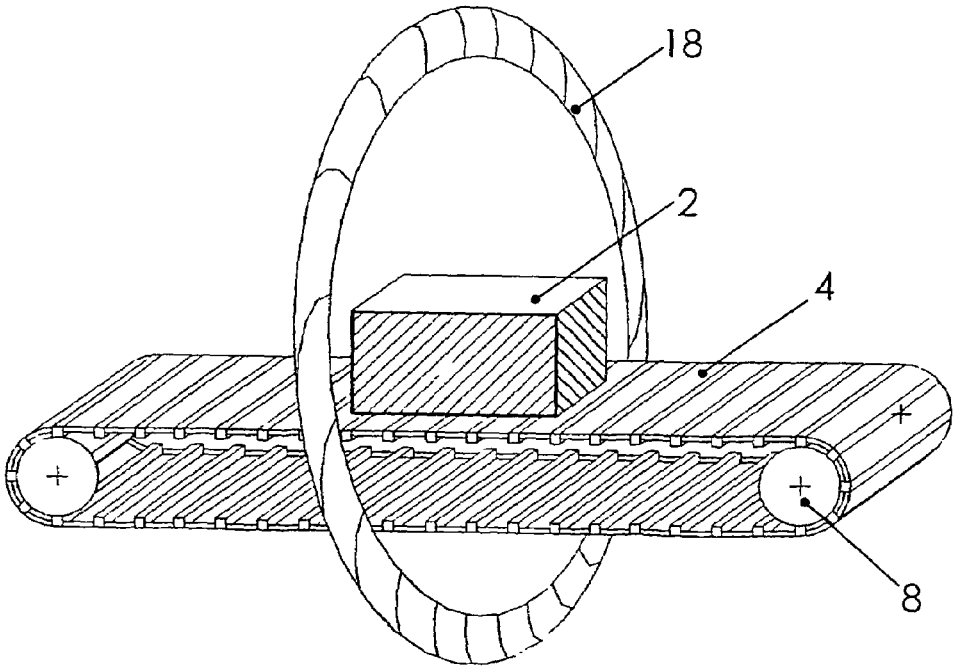
FIG. 4 is a schematic detailed view of a further embodiment of the device of the invention applied to conveyor belts.

The induction means 5, 10, 12, 14, 16, 18, 20, 21, 22 can be of several types, as shown in the various Figures, but it is readily evident for a skilled person in the art that the shown types are merely a non-limiting example, since numerous variations can be provided for such purpose. As shown in FIGS. 1, 2 and 4, the induction means are for example composed of at least one induction ring 5, 18, inside which the product 2 passes with the film 1 wrapped around it, in order to allow the film 1 to heat-shrink onto the product 2. The induction ring 5, 18 can be placed all around the conveyor belt 4, as shown, or can only surround the upper side of the belt 4 itself, that is the one supporting the product 2 when advancing. The ring 5, 18 can be of the coil type with a single turn, or with multiple turns, or can be composed of a plurality of rings in series, or other similar arrangements. FIG. 2 shows in particular the case in which the induction ring 5 is of great sizes and is supported along its vertical translation by an insulating riser 9: such arrangement is useful for packaging pallets of goods 2 with great sizes: by wrapping the pallet 2 with the film 1 and by lowering the induction ring 5 around the pallet 2, an accurate and uniform packaging is obtained, without the need of moving the pallet 2 itself in a big-sized oven.

Figure 3:
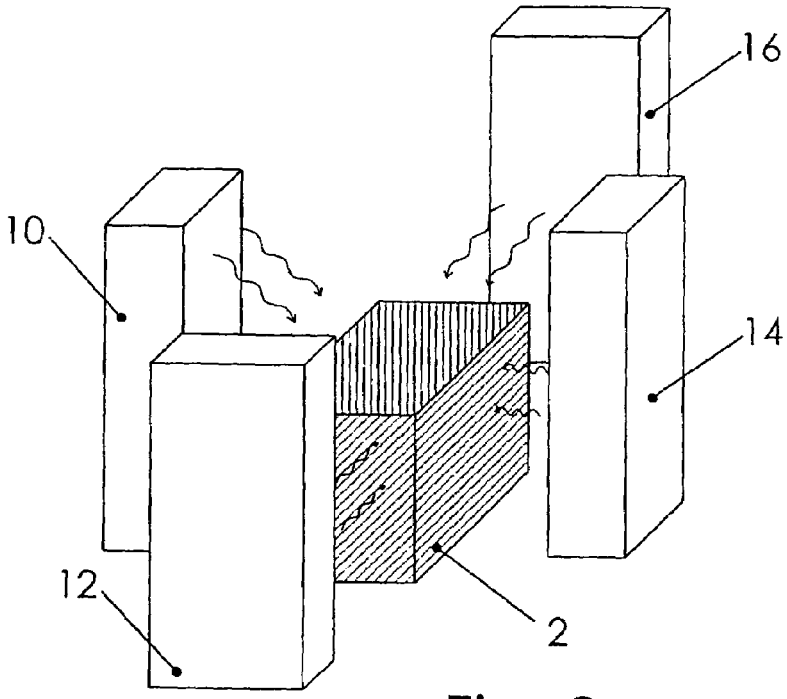
FIG. 3 is a schematic view of a variation of the device of the invention for packaging pallets.
Figure 5:
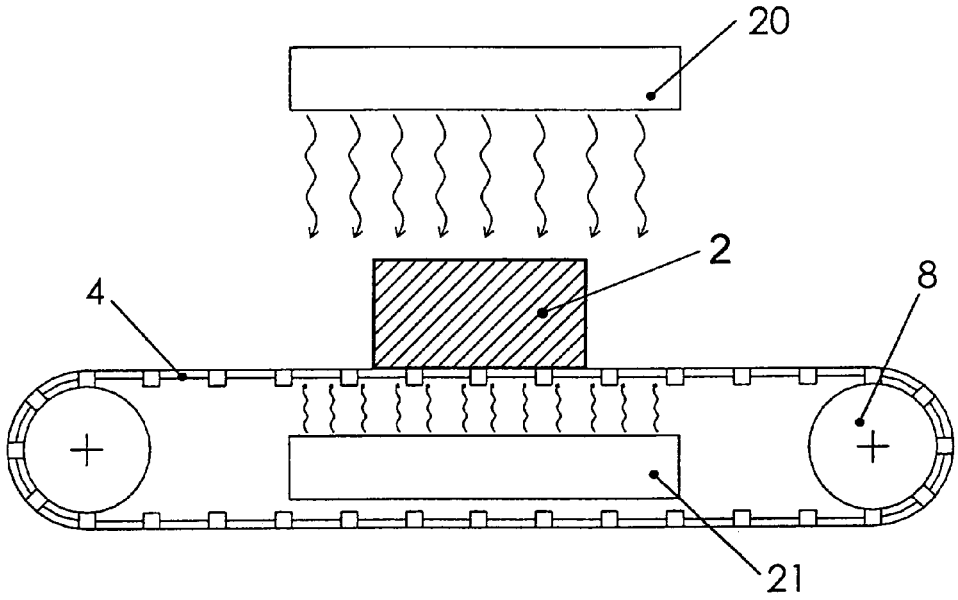
FIG. 5 is a schematic detailed view of a further embodiment of the device of the invention applied to conveyor belts.

FIG. 3 instead shows the packaging arrangement always applied to a pallet of goods 2, but that uses a plurality (in this case four) of plates 10, 12, 14, 16 placed around the four lateral sides of the pallet 2 and adapted to emit waves for shrinking the film 1 onto the pallet 2. The induction device arrangement as a plate is also present in FIG. 5, where there are two plates 20, 21 placed in such a way as to send waves onto two sides of a product 2 that passes on the conveyor belt 4 around which the plates 20, 21 are placed.

Obviously, the above-mentioned plates 10, 12, 14, 16, 20, 21 can be provided in any number at will, also equal to six for a product shaped as a parallelepiped onto which waves have to be sent on all its six sides: the final operating arrangement will depend on particular needs and on the emission power of the induction device.

Figure 6:
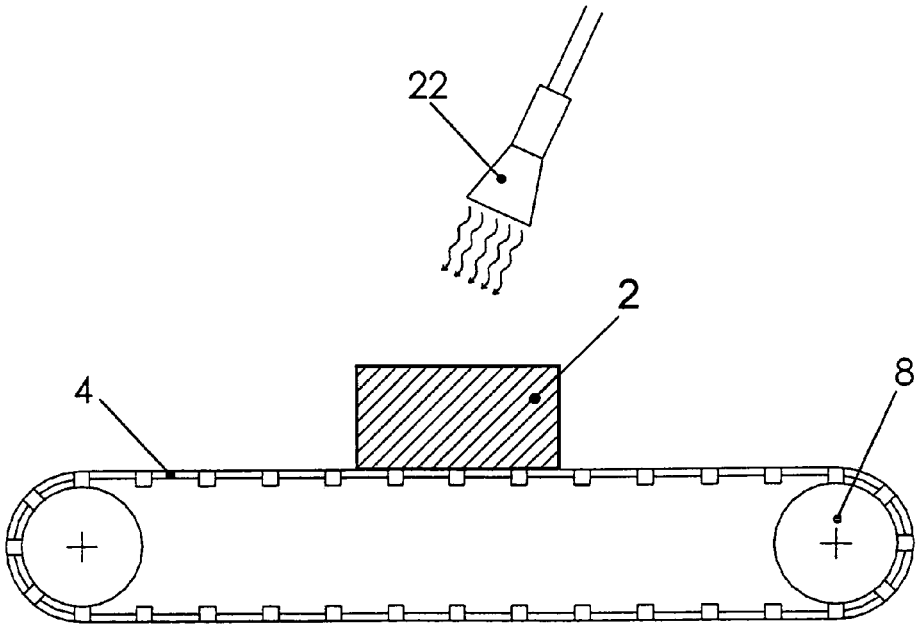
FIG. 6 is a schematic detailed view of another embodiment of the device of the invention applied to conveyor belts.

Moreover, the example in FIG. 6 shows the case in which the induction means are composed of at least one diffuser 22 adapted to emit waves towards the product 2 coated with the film and driven on the conveyor belt 4. Also in this case, the number of diffusers 22 can be chosen at will (for example two, four or six, placed one in front of the other on two, four or six opposite sides of the product, respectively), according to the particular application needs.

Finally, as already previously mentioned, the device of the invention, as shown in FIG. 7, in order to be able to perform the action for which it is foreseen, needs a particular heat-shrinking film 1, that is composed of at least one heat-shrinking uncharged plastic layer 30 to which at least one layer of film 32 is superimposed, charged with a material (preferably a metal) that is adapted to be heated by induction. In the preferred arrangement, the heat-shrinking film 1 is composed of at least two heat-shrinking uncharged plastic layers 30, 34 between which at least one layer of film 30 is sandwiched, charged with a material (preferably a metal) that is adapted to be heated by induction.

Moreover, in the preferred arrangement, the supply and control means 7 of the induction means 5, 10, 12, 14, 16, 18, 20, 21, 22 are composed of an electric supply and control circuit comprising common electronic components (transformers, alternators and capacitors) wherein such circuit supplies the induction means 5, 10, 12, 14, 16, 18, 20, 21, 22 through electric current, thereby inducing electromagnetic waves in them, that heat the film making it shrink onto the product.

Figure 8:
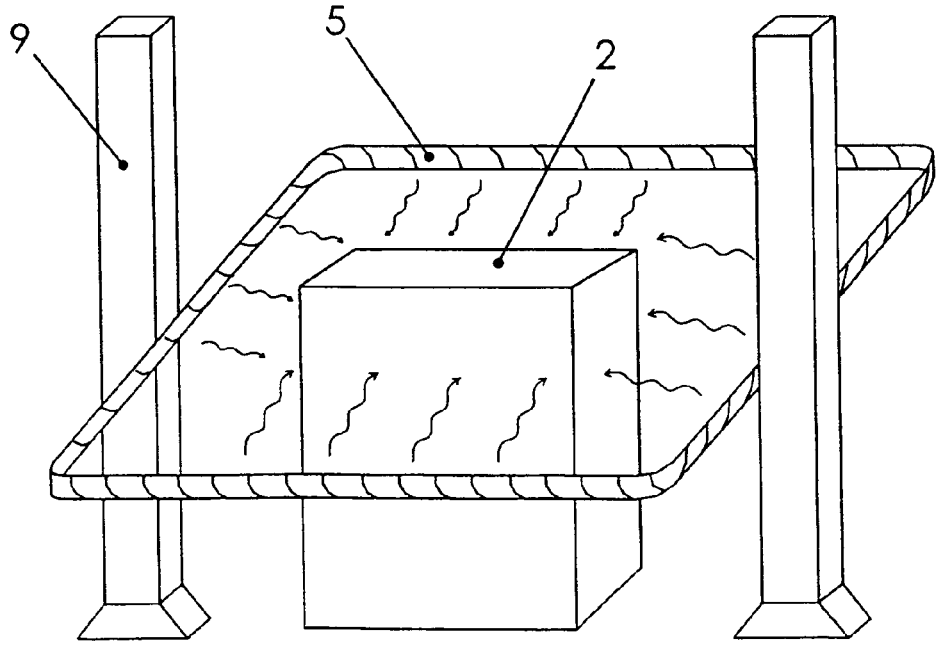
FIG. 8 is a schematic view of another possible embodiment of the device of the invention used for packaging pallets of goods having big sizes.

Finally, FIG. 8 shows a further preferred embodiment of the device of the present invention, in which the induction coil 5 is adapted for packaging pallets or other objects shaped as a parallelepiped, and for such purpose it is realised with a rectangular arrangement. It is clear from what is shown in the Figures, and in particular in FIGS. 2 and 8, that the shape of the induction ring or coil 5 is obviously different and can vary upon the user's choice or according to the end product 2 to be packaged.

With the above-described device and system, it is thereby possible to guarantee a better performance, reducing both environmental pollution and energy consumptions. Naturally, since the metallic material or other material to be heated that is part of the film is of a neglectable and very low weight, the power used by the induction device is also very low, and it is such as not to affect the environmental pollution in the slightest.

Some preferred embodiments of the present invention have been previously shown and described: obviously, the skilled people in the art will readily appreciate that numerous variations and modifications, that are functionally equivalent to the previous ones, can be made to the invention, such variations and modifications falling within the scope of the invention as pointed out in the enclosed claims. For example, other combinations or arrangements of the induction device can be provided, in order to generate waves both of the electromagnetic type and of another type, whose function always remains that of heating the heat-shrinking film allowing it to shrink onto the product.

What is claimed is:

1. An induction device for heat-shrinking a heat-shrinking film onto a product, where the heat-shrinking film comprises at least one layer of a charged film, comprising a material that is adapted to be heated by induction, superimposed on at least one layer of uncharged heat-shrinking plastic, the induction device comprising:

a) induction means for causing the heat-shrinking plastic layer of the heat-shrinking film to heat-shrink onto the product; and b) supply and control means for the induction means connected to the induction means;

where the induction means comprises at least one closed induction ring within which the product passes while the heat-shrinking film heat-shrinks onto the product.

2. The device according to claim 1, where the induction means generates electromagnetic radiation.

3. The device according to claim 1, where the heat-shrinking film comprises at least one layer of uncharged heat-shrinking plastic on each side of the charged film.

4. The device according to claim 1, where the material comprises a metal.

5. A packaging system comprising:

a) means for supplying a heat-shrinking film for packaging a product;

b) welding means for welding the heat-shrinking film onto the product; and c) at least one induction device according to claim 1, where the induction device is downstream of the welding means.

6. The system according to claim 5, further comprising at least one conveyor belt for transferring the product from a film packaging station to the induction device.

7. The device according to claim 1, further comprising protection means from the waves emitted by the induction device, where the protection means surround the induction device.

8. The device according to claim 7, where the protection means comprises a tunnel-shaped protection cage through which the product passes.

* * * * *